US006332400B1

(12) United States Patent
Meyer

(10) Patent No.: US 6,332,400 B1
(45) Date of Patent: Dec. 25, 2001

(54) INITIATING DEVICE FOR USE WITH TELEMETRY SYSTEMS

(75) Inventor: Steven J. Meyer, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/488,595

(22) Filed: Jan. 24, 2000

(51) Int. Cl.[7] ..... F42C 15/40
(52) U.S. Cl. ..... 102/264; 102/215
(58) Field of Search ..... 102/26, 215, 276, 102/264, 380, 222

(56) References Cited

U.S. PATENT DOCUMENTS

| | | | | |
|---|---|---|---|---|
| H1288 | | 2/1994 | Lusk . | |
| 4,375,192 | * | 3/1983 | Yates et al. | 102/215 |
| 4,739,705 | * | 4/1988 | Hudson et al. | 102/222 |
| 5,245,926 | * | 9/1993 | Hunter | 102/215 |
| 5,520,115 | * | 5/1996 | Braun | 102/215 |
| 5,936,188 | * | 8/1999 | Atkinson | 102/380 |
| 6,185,488 | * | 2/2001 | Nomoto | 701/29 |

FOREIGN PATENT DOCUMENTS

410278730-A * 10/1998 (JP) .

* cited by examiner

*Primary Examiner*—Peter M. Poon
*Assistant Examiner*—Floris C. Copier
(74) *Attorney, Agent, or Firm*—Earl Baugher, Jr.; David Kalmbaugh; Anthony J. Serventi

(57) ABSTRACT

A substitute solid state device for safely initiating a sustainer motor is provided. The substitute device replaces a mechanism that is integral to a warhead. The substitute device interfaces to a telemetry package and is suitable for insertion into small housings. A specific embodiment is a substitute interface to a telemetry system incorporating a circuit for firing a sustainer motor of a small missile or rocket. The substitute interface replaces the interface and firing circuit associated with the warhead in a missile of 2.75-inch diameter, such as the STINGER missile.

32 Claims, 3 Drawing Sheets

INITIATING DEVICE FOR USE WITH TELEMETRY SYSTEMS

FIELD OF THE INVENTION

The field of the invention is that associated with the provision of a replacement electromagnetic device used to initiate an action. Specifically a preferred embodiment of the present invention is an electromagnetic device that provides the necessary signal to initiate a sustainer motor on a small rocket or missile in which the warhead, with integral circuitry that is connected to a sustainer motor initiator, has been replaced by a telemetry package.

BACKGROUND

Despite the lack of test instrumentation specifically designed to fit in small volumes, there is continued pressure on the defense complex to deliver smaller, high performance weapon systems with quantifiable performance characteristics. Of course, it is expected that these be procured at a cost comparable to presently available weapon systems.

Currently there are no commercially available integrated secure telemetry systems suitable for use on small airframes, e.g., missiles or rockets. There are systems for recording data on board and later recovering the airframe and recorder as evidenced by those built by the U.S. Air Force at Eglin Air Force Base (AFB), Florida. These systems typically enjoy a 50% recovery rate, effectively doubling test requirements. Raytheon Corp. sells a system for use with the STINGER missile, however, it has no encryption capability nor does it have an IMU. The Navy at NAWC, China Lake, Calif. has built systems for use with small airframes but, these are not capable of encryption, have a limited number of channels for data capture and, do not have a fully capable IMU. Refer to U.S. Statutory Invention Registration H1288, *Control and Digital Telemetry Arrangement for an Aerial Missile*, issued to Kenneth P. Lusk.

In addition to the problem of squeezing a high performance telemetry package into a missile or rocket in place of its warhead, the necessary circuitry to insure reliable firing of the rocket or missile's sustainer motor must be provided in the same telemetry package in order to replace that firing circuitry packaged with the original warhead. Previous versions of the firing circuit used with the telemetry package used latching relays, a mechanical G-switch and, analog timing circuits. These components were bulky and, would have been difficult to integrate into a high performance telemetry package for use in a small volume. A new design, employing size and energy efficient solid state components, including digital timers, was needed.

SUMMARY OF THE INVENTION

A preferred embodiment of the present invention is a system interface designed to safely and reliably insure the firing of a sustainer motor about 250 milliseconds (ms) after launch of a rocket or missile. The sequence is:

- a longitudinal accelerometer, part of an inertial measurement unit (IMU) associated with a telemetry system, is sensed and upon reaching a pre-determined state, initiates timers within a programmable logic device (PLD);
- the PLD uses internal power from the missile or rocket, e.g., the "fuze power," to enable an initiator, typically a squib;
- by removing an electrical short, i.e., a path to electrical ground, across the squib's input an supplying suitable energy to the squib, the squib is energized, firing the sustainer motor.

In the missile's dormant state, the sustainer squib is shorted to ground in order to enhance safety in handling the missile or rocket prior to launch. The electrical short is removed only when the following sequence occurs:

- power up of the telemetry (TM) system and initiation of the missile's fuze battery occurring at launch, and
- reaching and maintaining an acceleration force of 25 G, or more, for 20 ms in a 40 ms window.

Occurrence of this sequence then enables an energizing signal to be delivered to the squib's input, resulting in the firing of the missile's sustainer motor at about 250 ms after actual launch.

This interface is designed to work in conjunction with a telemetry package having a power distribution board and fitted into a housing designed to replace the warhead in the current 2.75" family of small missiles and rockets. This integrated capability has not been able to be packaged for use in such small platforms heretofore.

Advantages of the solid state replacement firing circuit representing a preferred embodiment of the present invention are:

- compact configuration suitable for installation in small volumes
- capable of interfacing to both foreign and domestic systems
- low cost
- compatible with existing instrumentation
- easily upgraded with removable boards
- simple to maintain
- easy to program
- ruggedized
- easy interface to existing and planned systems
- reliable
- low power consumption With this replacement circuit designed to interface to an integrated telemetry system, test engineers and range instrumentation personnel will no longer have to provide workarounds or, otherwise estimate performance of small weapons systems such as 2.75" missiles or rockets. A rocket or missile will fly as if it had the actual warhead installed, enabling the vehicle's sustainer motor at the correct time after actual launch. Test data will be taken onboard, processed and, transmitted over a secure link to locations at which it can be properly analyzed, in near real time, for input to formal evaluations of the weapon system as it flies an actual test mission.

DETAILED DESCRIPTION OF THE INVENTION

The sequence of events pertaining to the operation of the circuit representing a preferred embodiment of the present invention follows. When power is applied to the system containing the circuit, a power-up reset circuit sets all outputs of a programmable logic device (PLD) to a pre-determined state. The timing of the reset circuit is mathematically described by:

$$V_C = S - S * e^{-\frac{t}{RC}} \quad (1)$$

where:

$V_C$ = voltage drop across the capacitor, volts ($V$)

$S$ = charging (source) voltage, $V$ $t$ = time, seconds ($s$)

$R$ = resistance of an $RC$ circuit, ohms ($\Omega$)

$C$ = capacitance of an $RC$ circuit, farads ($f$)

Figure 1:
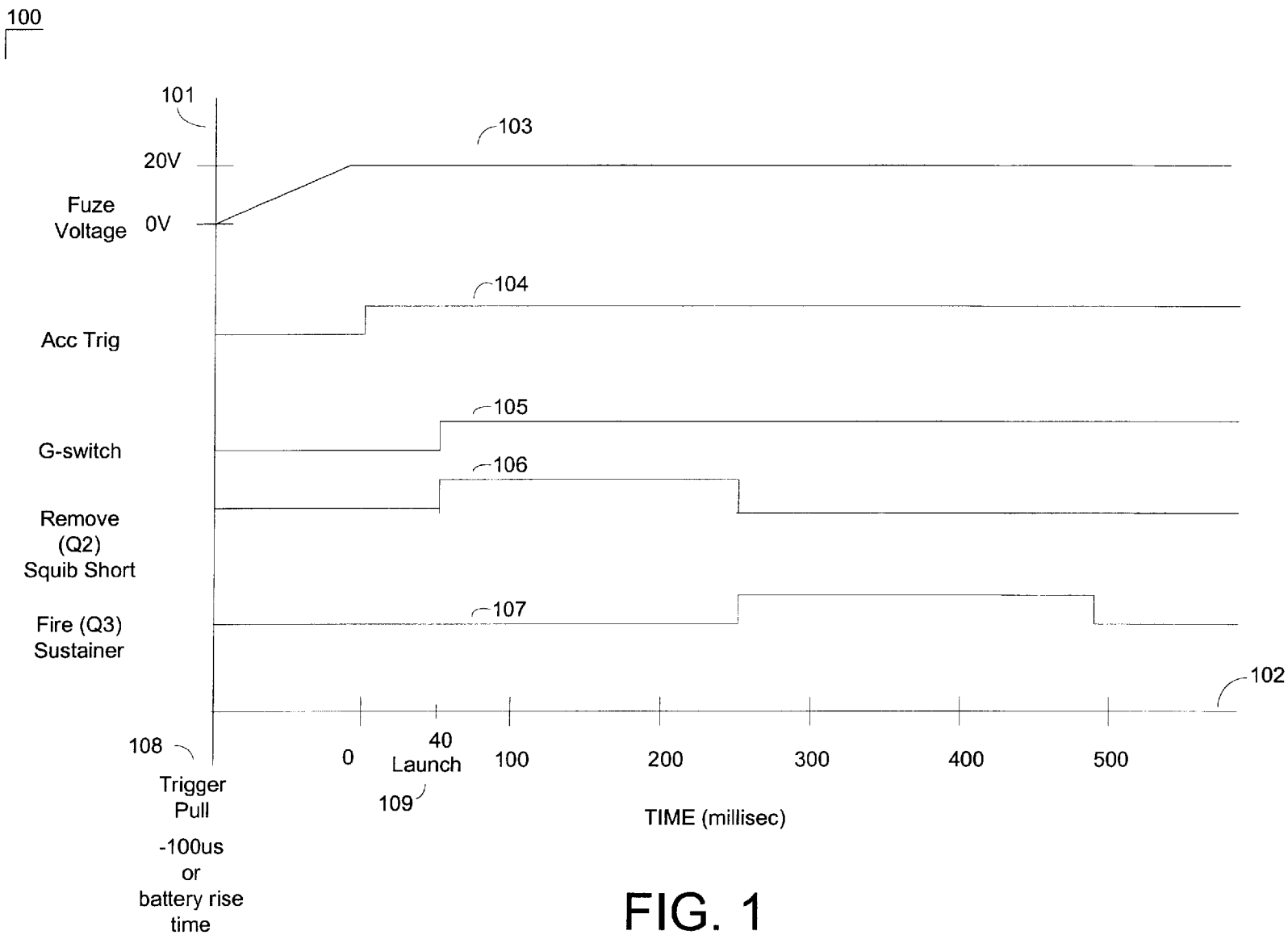
FIG. 1 represents the timing sequence of a preferred embodiment of the present invention.

After reset, a clock is generated using an RC circuit and feedback. The clock frequency, f, in Hertz (Hz), can be approximated by:

$$f = \frac{1}{2.2\,RC} \quad (2)$$

from Altera Corporation's *Application Handbook*, July 1998, p. 66. This clock is used as reference for timing as shown in the timelines of FIG. 1.

At launch, a launch accelerometer in the IMU of the onboard telemetry system sends a signal to the power/sustainer board, also more generally termed the power distribution board, from whence it is attenuated by an signal conditioning and, attenuator circuit consisting of a simple resistor divider network; a comparator having a reference voltage source, and a capacitor. When the accelerometer output attains a pre-determined value, the input level to the comparator rises causing the state of the comparator to switch. The output of the comparator is sent to an input of a PLD, enabling two timers. The first timer measures the time period that the launch accelerometer remains at or above a predetermined level. The second timer, termed the sustainer timer in a missile application, is used for control functions. When a pre-determined time has elapsed and, the first timer has determined that the accelerometer has remained at or, above its pre-determined level for a second pre-determined time, the second timer (sustainer timer) toggles a switch signal, sometimes referred to as "G-switch" in keeping with the nature of the output from the accelerometer.

The second timer has instituted a "guarantee" or safety signal that the missile has been launched. This status was determined by integrating the timer's received signal over the first predetermined time. Once the switch signal (G-switch) has toggled, the firing sequence for the sustainer motor is irreversible, since this G-switch signal toggles a physical switch that removes the "safety short" across the sustainer squib and, enables the connection that provides energy to the squib for firing the sustainer motor. However, if the launch accelerometer signal does not indicate a level at, or above, the predetermined level for the first predetermined time period, before the end of the second predetermined time period, the circuit is reset.

The sustainer motor's squib is shorted with a thermal relay. The current needed to fire the relay is provided by the missile's thermal battery. If the missile battery has not been initiated, such as by an actual launch, then the short to ground across the squib can not be removed. Under normal operation, the electrical short is removed at the end of the second pre-determined period after launch. At this time, the switch signal generated within the PLD, i.e., G-switch, is ANDed with a feedback signal from the sustainer timer's counters, causing an output on a physical switch, typically a MOSFET, allowing current through the thermal relay, thus interrupting the short to ground across the squib's input.

The sustainer timer is initiated by the comparator that switches state when the launch accelerometer signal indicates a G-force at, or above, a pre-determined value. The counters associated with the sustainer timer count to a third pre-determined time period at which time the signal to remove the short across the squib is toggled off and, the signal to fire the sustainer motor is sent to a second switch, typically a MOSFET, connected to the squib's input. The current for energizing the squib to fire the sustainer motor also comes from the missile's thermal battery, through the same line as the current, to remove the short across the squib.

At a fourth pre-determined time after launch, the squib's energizing current is removed by a signal from the sustainer timer by having the timer's counters disable the command signal to energize the squib. At this time these counters are also disabled from cycling again. To reset the counters, the power to the telemetry package has to be cycled. Under normal flight conditions, the firing circuit is inactivated for the remainder of the missile's flight.

The timing sequence for the key actions delineated above is provided in FIG. 1. The timeline of activities 100 is plotted as a representation of activity start 101 versus time 102 relative to initiation of a firing command for a missile, designated as "trigger pull" 108 on the timeline 100. All time and voltage values are provided as nominal values for relative comparison only and are not intended to be wholly representative of the invention. A launch signal 109 after trigger pull 108 may require 100 $\mu$s to get to the circuit to allow for rise time in the missile's thermal battery. At launch 109, time t=0, the fuze voltage 103 has reached a suitable level to enable an attenuated trigger signal from the accelerometer 104. At 40 ms after launch initiation, assuming the accelerometer still indicates a good launch, e.g., a 25 G force for at least 20 ms during the above 40 ms window, the G-switch 105 is toggled and the short across the sustainer motor's squib 106 is removed. At 250 ms after launch the sustainer motor's squib is energized 107, firing the sustainer motor.

EXAMPLE

Figure 2:
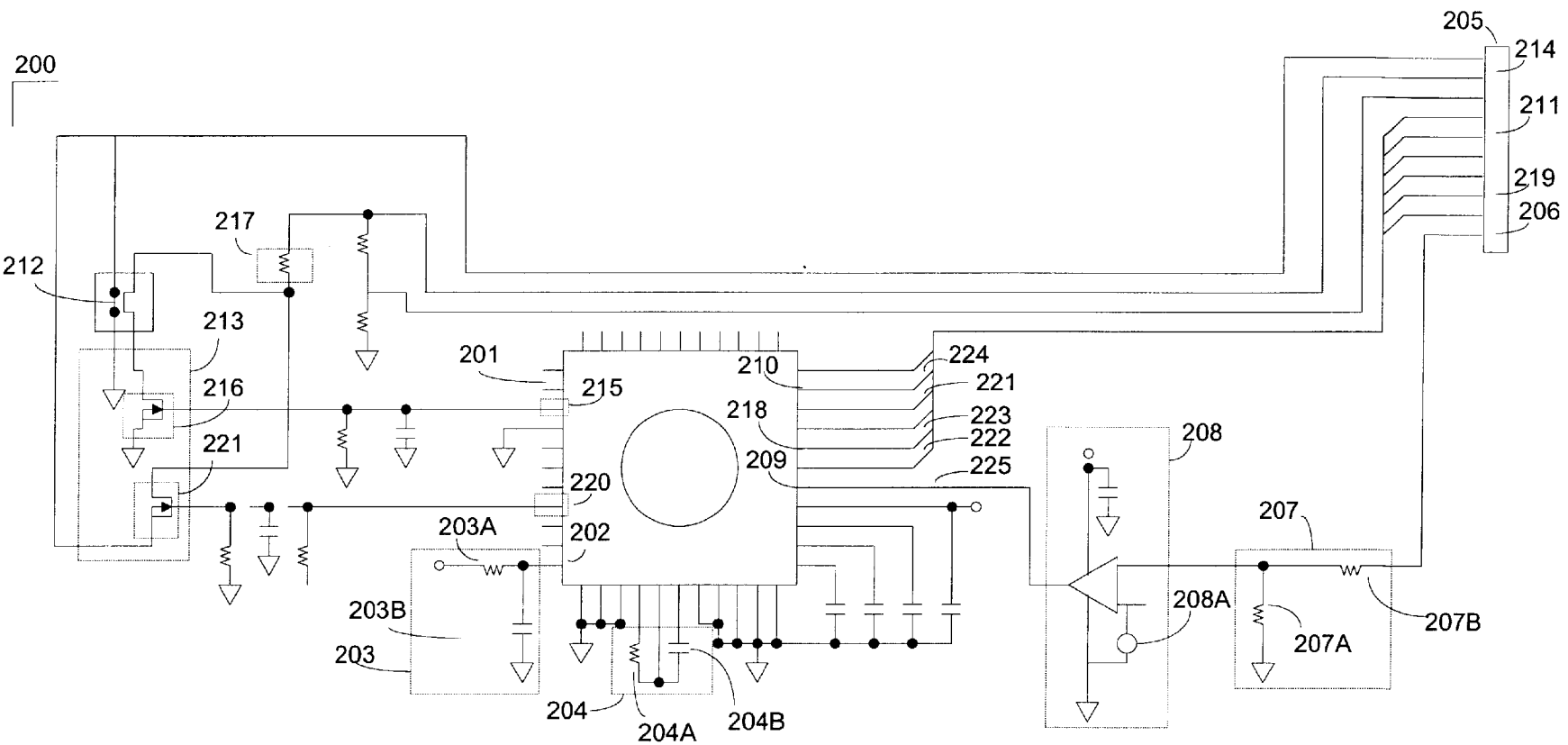
FIG. 2 is a circuit diagram of a preferred embodiment of the present invention.

A preferred embodiment of the present invention has been configured for installation in a STINGER missile of nominal 2.75" diameter. The missile's warhead has been removed and a telemetry system interfaced to a preferred embodiment of the present invention is installed in its place. Refer to FIG. 2 for the following discussion.

Upon powering up the telemetry system, a power up reset signal, nominally 5 V is input to the RC circuit 203 from which it is sent to the PLD 201, being inserted on pin 202. Values for resistor 203A of 75 KΩ and capacitor 203B of 0.47 $\mu$f are chosen so that the RC circuit 203 has a unique time constant compatible with the required setting of timers (not shown in FIG. 2) internal to the PLD 201. Applying Eqn. 1, for a value of 0.8 V available at pin 202, timing of the reset circuit, i.e., the time the voltage stays low after power is applied, is a guaranteed 6.15 ms. Therefore, the minimum guaranteed power-up reset pulse is one that is 6.15 ms in duration.

Upon power-up reset, a clock is generated using the RC circuit 204 comprising resistor 204A of 976 Ω and capacitor 204B of 0,47 $\mu$f. Inserting these values into Eqn. 2 yields a clock frequency of 990 Hz and a corresponding period of 1.009 ms. This clock controls the timing to carry out the timeline of FIG. 1.

A launch accelerometer (not separately shown), located in the inertial measurement unit (IMU) (not separately shown) of the telemetry system (not separately shown), is the sensor that will provide necessary triggering data for a preferred embodiment of the present invention. It is an ANALOG DEVICE MODEL ADXL 190 having an input range of +125 G to −75 G. At zero G the output voltage of the accelerometer is 1.80 V and at +25 G the output is 2.207 V. The signal from the accelerometer is sent to the power distribution board 205, inserted at pin 206. From pin 206 the accelerometer output is attenuated by the resistor divider network 207 comprised of resistor 207A of 143 KΩ and resistor 207B of 121 KΩ. This provides an input voltage to the comparator 208 of 1.2 V when the output level from the accelerometer is at 2.207 V. The comparator is provided with its own reference voltage source 208A. Once the comparator 208 reaches 1.2 V it switches states. The output of the comparator 208 is inserted at pin 209 of the PLD 201 whereupon it enables two timers (not separately shown in FIG. 2). The first timer tracks the time period in which the accelerometer output indicates a force at or above 25 G. The second timer, or sustainer timer, is used as the control timer for all functions of the interface representing a preferred embodiment of the present invention.

Upon counting a period of 40 ms, given that the accelerometer has indicated a force at or above 25 G for a period of 20 ms during the above 40 ms period, a signal termed "G-switch" is toggled. (If the accelerometer does not indicate a 25 G force for the entire 20 ms time period during the 40 ms time period, the circuit is reset.) This is provided at pin 210 of the PLD 201 and sent to pin 211 of the power distribution board 205. The sustainer timer "guarantees" that the missile has launched, hence the signal indicating a 25 G force as measured by the accelerometer and provided by the comparator 208, is integrated over time for the 40 ms period. Once the G-switch (not separately shown) has toggled, the firing sequence is irreversible.

The G-switch performs two functions. ANDed with a feedback signal from the sustainer timer, it initiates the removal of the short 212 across the squib's input 213. It also starts the sustainer timer for energizing the squib to fire the sustainer motor.

The squib input 213 is shorted with a thermal relay 212. Current (not separately shown) for firing the thermal relay 212 is provided by the missile's thermal battery (not separately shown) and is inserted at pin 214 on the power distribution board 205. The missile's thermal battery is not activated unless the missile has been launched, hence the short across the squib can not be removed absent missile launch.

Once a "good" 40 ms post-launch period is determined, the G-switch signal is ANDed in the PLD 201 with feedback from the sustainer timer (not separately shown), causing an output at pin 215 that is provided to MOSFET switch 216, allowing current to flow through thermal relay 212.

In the case of the STINGER missile, the fuze power is provided at 20 V from pin 214 and the current limiting resistor 217 is zero, i.e., a short. The "on" resistance of MOSFET 216 is 0.028 Ω, the fuze power impedance is 3.45 Ω, and the total resistance of the thermal relay 212 is 4.828 Ω. This yields an average current of 4.14 amps (A), given a 20 V input. The response time for the relay (not separately shown), an M999, is about 60 ms. Thus, at about 110 ms after launch, the squib can be enabled.

The sustainer timer is initiated by the comparator 208. The counters of the sustainer timer count to 250, representing 250 ms, at which time the signal to remove the short across the squib is toggled off at pin 218 of the PLD 201 to pin 219 of the power distribution board 205, and the signal to energize the squib to fire the sustainer is inserted at pin 220 of the PLD 201 to MOSFET switch 221. The current used to fire the sustainer also comes from the fuze power line connected to pin 214, described above. For the example of a STINGER missile, the battery voltage available is 20 V and its impedance is 3.45 Ω. MOSFET switch 221 has an "on" resistance of 0.028 Ω and the sustainer squib (not separately shown) has a resistance of 1.70 Ω. Thus, the total resistance is 5.17 Ω, resulting in a firing current of 3.86 A until about 500 ms after launch. The counters (not separately shown) associated with the sustainer timer in the PLD 201 then initiate a signal to disable the "fire sustainer" command from pin 221, simultaneously disabling these counters from initiating another count. To reset these counters, telemetry power must be cycled. Thus, with a successful missile launch and sustainer motor firing, this circuit becomes inactive.

All the circuits activated by the PLD are monitored by the telemetry system. They are all discrete signals provided at pins 222, 218, 221, 225, 210, 224, and 223.

Figure 3:
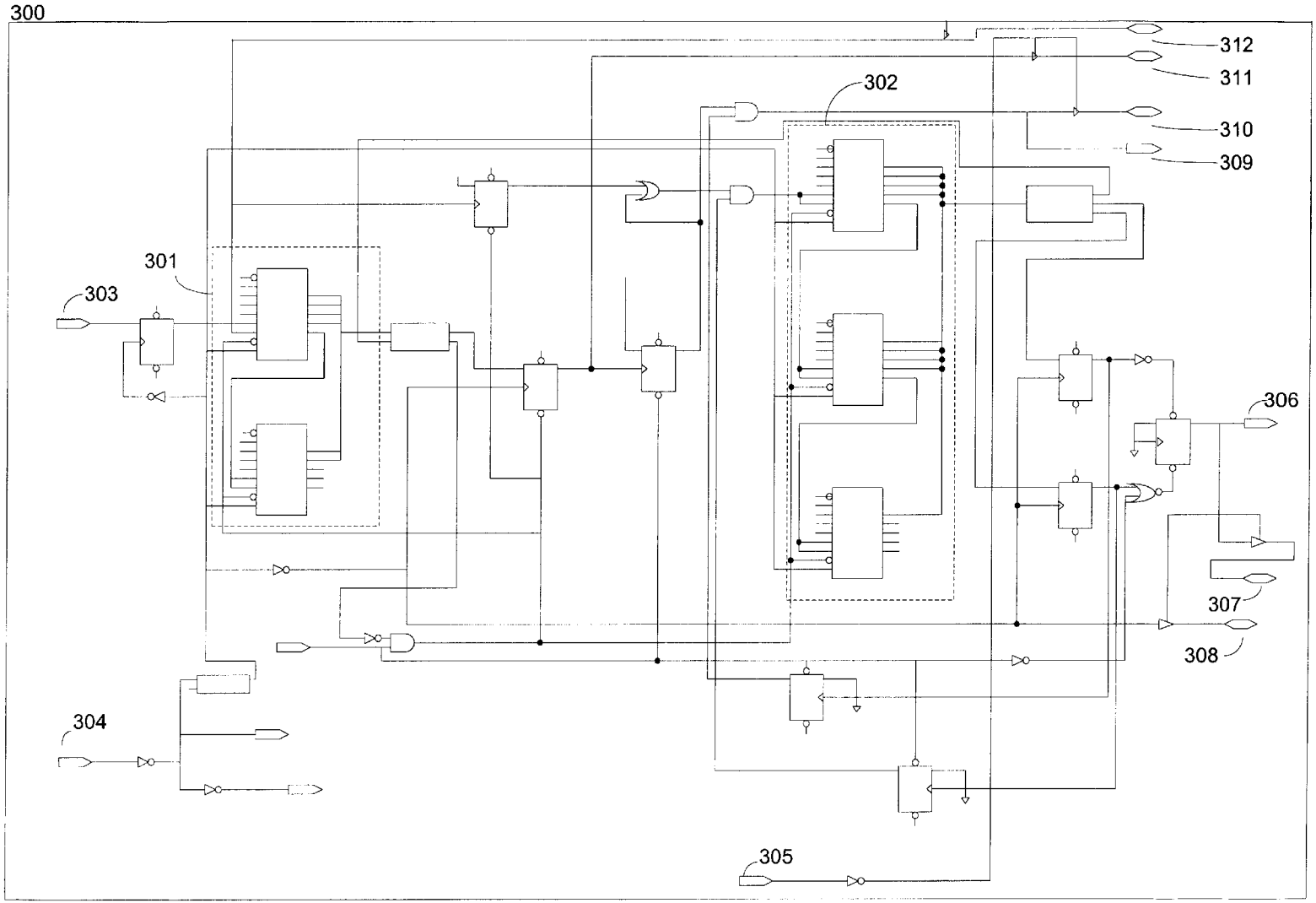
FIG. 3 is a circuit diagram of the timers within the PLD of a preferred embodiment of the present invention.

FIG. 3 depicts the layout of the digital timer configuration 300 for the two counters 301 and 302 internal to the PLD 201. The counter 301 counts the 20 ms period during which the longitudinal acceleration, input as signal longacc 303, remains at or above 25 G. A feedback signal 304 is also provided to the counters to insure correlation. The counter 302 counts the 40 ms period during which the 20 ms period of acceleration is experienced, the 250 ms period during which the squib is energized for firing the sustainer, and the 500 ms period at the end of which the signal is inactivated. Upon initiation of an enable signal 305 and occurrence of a proper timing sequence, a firing signal 306 is output together with a firing monitoring signal 307 and a clock signal 308.

Prior to an enabling signal 305, signal GSWITCH 311, ACCTRIG 312, SQUIB 309, and SQUIBMON 310, are sent to insure the proper firing sequence once an enabling signal is called for by the initiation of a proper timing sequence.

Although a specific embodiment has been described in the specification and further represented in drawings, these are not to be taken as limiting. Rather, the full scope and meaning of the invention is to be as interpreted from the following claims.

I claim:

1. An action enabling apparatus, comprising:

a device, having inputs and outputs, for timing activities and for activating signals based on the occurrence of a pre-determined sequence of events;

a programmable logic device (PLD), incorporating timers and a first switch, and having inputs and outputs;

a clock, having inputs and outputs, operably connected to said PLD;

a first set of signal paths from said device to a first system, incorporating a sensor and having access to a power source, said first set of signal paths operably connected to said inputs of said PLD, said first set of signal paths comprising, a first signal path, operably connecting said clock and said PLD, for carrying a signal from said clock, a second signal path, operably connecting said PLD and said first system, for carrying a signal representative of event status as measured with said sensor, a third signal path incorporating a reset circuit, operably connecting said PLD and said power source associated with said first system, for carrying a reset signal; and a fourth signal path, operably connecting said PLD and said power source, for powering said PLD by said power source;

a second set of signal paths from said first system to a second system, said second system incorporating an initiator;

a third set of signal paths from said device to said initiator;

a second switch, a thermal relay operably connected to said PLD through said second switch; and a third switch operably connecting said PLD to said second system, wherein said action enabling apparatus initiates an action in said second system only upon a proper occurrence of said pre-determined sequence of events, and wherein said PLD has the outputs of said PLD set to a pre-determined value at receipt of said reset signal, initiated upon power up of said first system by said power source.

2. The action enabling apparatus of claim 1 wherein said first system comprises a telemetry system and said second system comprises a sustainer motor incorporating an initiator.

3. The action enabling apparatus of claim 1 wherein said second set of signal paths comprises:

a fifth signal path from said first system to said second system through said PLD, said second switch and said thermal relay for removing a path to electrical ground across the input of said initiator associated with said second system;

a sixth signal path from said first system to said second system for providing power to said initiator; and a seventh signal path from said first system to said second system for monitoring said power provided to said initiator, whereupon the removal of said path to electrical ground and insertion of a pre-determined signal on said seventh signal path provides energy to said initiator for activating said second system.

4. The action enabling apparatus of claim 1 wherein said third set of signal paths comprises:

a first subset of signal paths for providing event status signals to said first system from said PLD; and a second subset of signal paths for providing an electrical ground for said PLD and for providing an enabling signal from said PLD to a third switch operably connected to said initiator.

5. The action enabling apparatus of claim 4 wherein said first subset of signal paths comprises:

an eighth signal path from said PLD for providing clock information to said first system;

a ninth signal path from said PLD for providing status about a switch signal to said first system;

a tenth signal path from said PLD for providing a signal to said first system related to providing power to said initiator of said second system;

an eleventh signal path from said PLD to said first system for providing a signal related to triggering a timing action associated with a pre-determined level of output of said sensor;

a twelfth signal path from said PLD to said first system for providing status associated with the default condition of said initiator; and a thirteenth signal path from said PLD to said first system for providing status about an enabling signal, wherein said first subset of signal paths provides timing and control status concerning signal paths among said PLD, said second system, and said first system.

6. The action enabling apparatus of claim 4 wherein said second subset of signal paths comprises:

a fourteenth signal path to electrical ground from said PLD;

a fifteenth signal path from said PLD to said second switch; and a sixteenth signal path from said PLD to said third switch;

wherein, the appearance of a first and second pre-determined signal on each of said fifteenth and sixteenth signal paths, respectively, in concert with a third pre-determined signal on said sixth signal path, removes said path to electrical ground across the input of said initiator and energizes said initiator.

7. The action enabling apparatus of claim 1 wherein said clock comprises a first RC circuit and a feedback path from said PLD.

8. The action enabling apparatus of claim 1 wherein said sensor is an accelerometer.

9. The action enabling apparatus of claim 1 wherein said second signal path incorporates an attenuator circuit.

10. The action enabling apparatus of claim 9 wherein said attenuator circuit comprises:

a voltage divider, operably connected to a power distribution board of said first system, for attenuating an input signal;

a comparator, operably connected between said voltage divider and electrical ground and further connected to said power source and a reference voltage source, and a capacitor, wherein said attenuator circuit provides an input to said PLD necessary to enable said timers.

11. The action enabling apparatus of claim 1 wherein said initiator is a squib.

12. The action enabling apparatus of claim 1 wherein said second and third switches are MOSFETs.

13. A substitute initiating device to be deployed with a telemetry system incorporating a power source and a power distribution board interfacing to a sustainer motor in cooperation with said device, said sustainer motor incorporating an initiator having an input and an output, comprising:

a programmable logic device (PLD), incorporating a first switch and timers, said PLD having inputs and outputs;

a clock, for providing a timing reference, operably connected to said PLD;

a signal conditioning circuit, for conveying an input from a sensor, operably provided between the power distribution board and said PLD;

a shorting circuit incorporating a thermal relay, for establishing an electrical path to ground across an electromagnetically activated initiator, said shorting circuit operably connected to said initiator, said PLD through a second switch, and the power distribution board;

an enabling circuit, operably connected to said initiator, the power distribution board, and said PLD through a third switch, for enabling said initiator;

a reset circuit for enabling said outputs of said PLD to be set to a pre-determined level upon power up of said telemetry system, said outputs set to said pre-determined level by said reset circuit upon power up of the telemetry system;

a power circuit for providing power to said PLD from said telemetry system; and signal paths provided for communication of status, said signal paths operable between said PLD and the power distribution board, wherein said substitute initiating device fires said sustainer motor only upon the proper occurrence of a pre-determined sequence.

14. The initiating device of claim 13 wherein the status of said first switch is operably communicated between said PLD and the power distribution board.

15. The initiating device of claim 13 wherein feedback from a sustainer counter internal to said PLD is ANDed with input from said first switch and provided to said third switch, wherein, energy is provided to the initiator along a path in said enabling circuit from the power distribution board to the initiator through said third switch.

16. The initiating device of claim 13 wherein said clock comprises a first RC circuit and a feedback path from said PLD.

17. The initiating device of claim 13 wherein said sensor is an accelerometer.

18. The initiating device of claim 13 wherein said second and third switches are MOSFETs.

19. The initiating device of claim 13 wherein said signal conditioning circuit also serves as an attenuator circuit.

20. The initiating device of claim 19 wherein said signal conditioning and attenuator circuit comprises:

a voltage divider, operably connected between said PLD and the power distribution board, for attenuating an input signal to said PLD;

a comparator, operably connected to said voltage divider and incorporating a built-in reference voltage referenced to electrical ground, said comparator provided power from the power source, and a capacitor, wherein said attenuator circuit provides an input to said PLD necessary to enable said timers.

21. The initiating device of claim 13 in which the shorting circuit comprises:

a first connection from the power distribution board to said thermal relay; and a second connection from said PLD to said second switch, wherein insertion of a signal of proper level on each of said first and second. connections results in removal of said electrical path to ground across said initiator.

22. The initiating device of claim 13 in which said enabling circuit comprises:

a third connection, said third connection extending from the power distribution board to said inputs of said second and third switches, said third connection incorporating a resistor;

a fourth connection, comprising a second RC circuit having a pre-determined time constant, operably connecting said PLD and said input of said second switch; and a fifth connection, comprising a third RC circuit having a predetermined time constant similar to said second RC circuit, operably connecting said PLD, said input of said third switch and a voltage from the telemetry system as reduced by a series resistor, wherein said third connection energizes, said initiator, pending the proper occurrence of said predetermined sequence and removal of said electrical path to ground across said initiator.

23. The initiating device of claim 13 further comprising a power monitoring circuit operably connected to a first resistor, said first resistor having two ends, a first end connected to the power distribution board and a second end connected to said resistor in said enabling circuit, and a second resistor, having two ends, a first end connected to the power distribution board and said first end of said first resistor and a second end operably connected to electrical ground, wherein power level in said monitoring circuit as provided from the power distribution board is monitored.

24. The initiating device of claim 13 which said signal paths between said PLD and the power distribution board comprise:

a sixth connection for carrying a signal representative of a function of said clock;

a seventh connection for carrying a signal representative of a function of said switch;

an eighth connection for carrying a signal representing a firing decision of said PLD;

a ninth connection for carrying a signal representative of event status as measured with said sensor;

a tenth connection for representing said default condition of said initiating device; and an eleventh connection for carrying a signal permitting the enabling of said initiator, wherein said sixth through eleventh connections provide status of activity among said PLD, said initiator, and said telemetry system.

25. A method for insuring safe and reliable initiation of a device, comprising:

detecting a sequence of events;

determining a proper order of occurrence of said sequence of events; and initiating the device upon determination of said proper order of occurrence, wherein said device is initiated within a few tenths of seconds after initiation of said sequence of events, wherein inadvertent initiation of the device is prevented via an electrical path to an electrical ground across an initiator provided through a thermal relay operably connected to a second switch, and wherein at a pre-determined event within said sequence of events, said second switch is closed permitting energy to flow from a power source through said thermal relay and interrupt said electrical path to said electrical ground across said initiator.

26. The method of claim 25 wherein a sustainer motor of a missile is initiated, said sustainer motor incorporating said initiator activated through cooperation among a first switch, said second switch, and a third switch.

27. The method of claim 26 wherein detecting a predetermined sequence of events is achieved by a programmable logic device (PLD) operably connected between a first system, said system having access to a source of power and incorporating a sensor, a clock, and said second and third switches.

28. The method of claim 27 wherein said first system is an internally powered telemetry system, incorporating an accelerometer as said sensor and a power distribution board, and said clock is an RC circuit with a pre-determined time constant operably connected to said PLD and receiving feedback therefrom.

29. The method of claim 25 wherein said electrical path to said electrical ground is removed via provision of electrical energy from a source of power associated with said first system to a thermal relay maintaining said electrical path to said electrical ground when no signal is present, wherein said electrical path is removed by applying sufficient energy to said thermal relay to interrupt said electrical path to said electrical ground.

30. The method of claim 26 wherein said the device is initiated upon determination of the proper occurrence of said sequence provided as a first signal from said first system, a second signal from said PLD to said second switch and a third signal from said PLD to said third switch, wherein initiation of said first, second, and third signals is controlled by said PLD using a pre-determined timing sequence measured by timers internal to said PLD and said clock.

31. The method of claim 26 wherein said sequence is associated with times as follows:

$t_0$ is about the time of launch of said missile;

$T_1$ is a period of time about X milliseconds (ms) in duration occurring after said $t_0$;

$T_2$ is a period of time about Y ms in duration occurring after said $t_0$;

$T_3$ is a period of time about Z ms in duration occurring after said $t_0$ that includes said $T_2$ and $T_1$ periods, given that said sensor provides to said PLD a value at or above a pre-determined value for the duration of said $T_1$ period during said $T_2$ period, $T_4$ is the total elapsed time, W, after $t_0$ in which an initiation signal is active;

wherein W>Z>Y>X, and wherein said first, second, and third signals are sent to open said first and second switches at about the end of period $T_3$, thus energizing said initiator and firing said sustainer motor, and wherein said initiation signal is inactivated at $T_4$=W.

32. The method of claim 31 such that:

X is about 20;

Y is about 40;

Z is about 250;

W is about 500; and said predetermined value is about 25 G.

* * * * *